US007470077B2

(12) United States Patent
Thiebaut et al.

(10) Patent No.: US 7,470,077 B2
(45) Date of Patent: Dec. 30, 2008

(54) APPLICATOR DEVICE FOR A PRODUCT, IN PARTICULAR A COSMETIC PRODUCT

(75) Inventors: Laure Thiebaut, Clichy (FR); Roger Chapelle, Le Palais sur Vienne (FR)

(73) Assignee: L'Oreal, Paris (FR)

( * ) Notice: Subject to any disclaimer, the term of this patent is extended or adjusted under 35 U.S.C. 154(b) by 559 days.

(21) Appl. No.: 11/211,478

(22) Filed: Aug. 26, 2005

(65) Prior Publication Data

US 2006/0045607 A1 Mar. 2, 2006

Related U.S. Application Data

(60) Provisional application No. 60/608,891, filed on Sep. 13, 2004.

(30) Foreign Application Priority Data

Aug. 27, 2004 (FR) ..... 04 51916

(51) Int. Cl.
*A47L 13/30* (2006.01)
*B43M 11/06* (2006.01)
*A45D 40/24* (2006.01)

(52) U.S. Cl. ..... 401/132; 401/262; 401/261; 132/317

(58) Field of Classification Search ..... 401/7, 401/8, 132, 133, 261, 262, 267; 132/317, 132/320; 15/104.92, 104.93
See application file for complete search history.

(56) References Cited

U.S. PATENT DOCUMENTS 5,794,774 A * 8/1998 Porcelli ..... 206/369
2004/0258457 A1* 12/2004 Legendre ..... 401/205

FOREIGN PATENT DOCUMENTS

EP 0 460 649 A1 11/1991
EP 1 374 718 A1 1/2004

* cited by examiner

*Primary Examiner*—David J Walczak
(74) *Attorney, Agent, or Firm*—Oblon, Spivak, McClelland, Maier & Neustadt, P.C.

(57) ABSTRACT

An applicator device for a cosmetic product includes a backing sheet in which at least one applicator is cut out or pre-cut. The backing sheet includes a first face which, over at least part of the applicator, holds the cosmetic product, and a second face having an adhesive associated therewith over at least part of the applicator. In addition, a film extends over at least the adhesive-coated part of the second face, with the film capable of being at least partially detached from the backing sheet to give access to the applicator and enabling the applicator to be lifted off by its adhesive face.

44 Claims, 4 Drawing Sheets

APPLICATOR DEVICE FOR A PRODUCT, IN PARTICULAR A COSMETIC PRODUCT

CROSS-REFERENCE TO RELATED APPLICATIONS

This document claims priority to French Application Number 04 51916, filed Aug. 27, 2004 and U.S. Provisional Application No. 60/608,891, filed Sep. 13, 2004, the entire content of which are hereby incorporated by reference.

BACKGROUND OF THE INVENTION

1. Field of the Invention

The invention relates to product applicators. The invention can be particularly advantageous in providing an applicator for cosmetic products, which is designed to adhere to one or more fingers to facilitate application of the product on a surface to be treated.

2. Discussion of Background

The expression "cosmetic product" is understood to mean a product such as defined in Council Directive 93/35/CEE dated Jun. 14th, 1993, amending Directive 76/768/CEE for the sixth time.

Applicators exist that have a substantially flat shape and which incorporate a layer of adhesive enabling them to be attached to a finger for the purpose of applying a product, as is the case with the applicator described in patent application EP 1 374 718.

Generally, the adhesive surfaces are covered by a backing sheet designed to protect the adhesive, and the applicator is lifted off the backing sheet before use.

To facilitate the lifting of such applicators off the backing, it is known to place them in dispensers. Patent application EP 1 374 718 describes for example several applicators attached to a carrier tape which is wound onto a dispenser. Such a dispenser is more suitable for dispensing a relatively large quantity of applicators attached to a relatively long strip enabling it to be wound onto the dispenser.

Patent application EP 0 460 649 also describes known adhesive labels that are partially superimposed one upon the other. The labels are thus wound onto a dispenser, with no additional carrier tape or with only a thread attached to the adhesive face of the labels to connect them together and to thereby facilitate their separation. Here again, such an arrangement is more suited to the dispensing of a relatively large quantity of labels capable of being wound on the dispenser. Moreover, the labels are designed to be picked up automatically on a production line by an arm which presses on the face opposite the adhesive face of the label so as to detach it from the label which is contiguous therewith and to attach the label to a bottle. This type of arrangement is not suited to product applicators designed to adhere to a fingertip. Furthermore, it is necessary to press on the face opposite the adhesive face in order to separate two labels, so that such an arrangement is not well suited to applicators wherein the face opposite the adhesive face is designed to be applied to the skin. In effect there is a risk that this surface will become soiled and/or that product will be removed when the applicator holds a product to be applied.

Also, certain adhesive articles are designed to be packaged individually with a detachable backing to protect their adhesive face. For example, dressings often incorporate a backing divided into two parts which overlap to form a grasping zone. To detach the dressing from its backing, it is necessary to grasp the device in one hand placing a finger on each of its faces and to then fold the device to allow the grasping zone of the backing to be held in order to detach it. For this type of article, this does not pose a problem insofar as the dressing does not hold a product. However, in the case of product applicators, it is preferable not to touch the application face to avoid contaminating the surface and soiling the fingers. In addition, when the product is disposed at the surface, in particular in the form of a layer of powder, there is a risk that the product layer will break up if the article is folded.

SUMMARY OF THE INVENTION

One of the objects of the invention is therefore to propose an adhesive applicator which avoids or reduces the drawbacks of the prior art.

Another object of the invention is to provide an adhesive applicator that is convenient to use.

A further object of the invention is to provide an applicator that can be readily grasped without damaging its application surface.

It is also an object of the invention to provide an applicator that can be readily grasped without risk of soiling the fingers.

According to a preferred example of the invention, an applicator device for a cosmetic product is provided which includes a backing sheet in which at least one applicator is cut out or pre-cut. The backing sheet includes a first face which holds the cosmetic product; and a second face has an adhesive associated therewith for all or part of the applicator with the adhesive provided, for example, as an adhesive coating. A film extends over at least the adhesive-coated part of the second face, with the film being capable of detaching at least partially from the backing sheet to give access to the applicator and enable it to be lifted off by its adhesive face.

The backing sheet surrounding the applicator thus forms a grasping zone which can be grasped so as to hold the applicator without touching the application surface.

The film can include a cut line or line of weakening extending at least partially around the applicator so as to delineate a portion that is at least partially detachable and at least partially covering the applicator and which, when it is separated from the rest of the film, gives access to the applicator and allows it to be lifted off by its adhesive face.

The whole film or the detachable portion of the film separable from the rest of the film can be detached from the backing sheet to give access to the applicator, thereby enabling the user to readily place one or more fingers thereon so as to lift off the applicator. As soon as it has been lifted off, the applicator can then be used to apply the product.

The second face of the backing sheet can additionally be affixed to at least one portion external to the applicator so as to hold the rest of the film on the backing sheet once the detachable portion is separated.

The applicator can be attached to the backing sheet, for example, by at least one bridge of material. The bridge or bridges of material are obtained for example by non-cutout portions of the backing sheet.

By choosing sufficiently large bridges of material, it is possible to use an adhesive with a relatively strong adhesive capacity without risk of removing the applicator from the rest of the backing sheet when the detachable portion of the film is removed, and the applicator is adequately held by the bridges of material.

Alternatively, the applicator can be cut on a continuous line in the backing sheet so that it is not attached to the backing sheet. For example, a backing sheet of sufficient thickness can be selected so as to be able to hold the applicator on the rest of the backing sheet by friction only.

The backing sheet can surround the applicator around its entire periphery. The user can thus grasp the backing sheet at several points.

Also, by way of example, the line of weakening can be a thinner area of the film extending along a line which can be continuous or discontinuous.

The cut line can be continuous or discontinuous.

The cut line or line of weakening can extend over one or more straight and/or curved portions.

The detachable portion of the film can be, at least partially, delineated by a peripheral edge of the film. The detachable portion can thus be readily grasped by the user. The backing sheet can be impregnated with a product to be applied and/or the first face of the backing sheet can be covered by a layer of a product to be applied. Further by way of example, the first face of the backing sheet can include product only against the applicator.

The product can be a cosmetic product.

The backing sheet can be made of a porous or fibrous material, for example, a thermoplastic foam material, sponge, felt, non-woven material, or a woven material, for example, of natural fibres such as cotton.

Also by way of example, the backing sheet can be made of a resiliently deformable material so as to obtain a relatively flexible application.

The backing sheet can include a multi-layered structure.

The first face of the backing sheet can be covered, for example, in a flock material, a non-woven or a woven material.

The film can be a medium treated with silicone, notably silicone-treated paper.

The second face of the backing sheet can include a hypoallergenic adhesive.

The second face of the backing sheet can be entirely covered with adhesive. Alternatively, the second face of the backing sheet can be partially affixed to the applicator and to at least one portion external to the applicator.

By way of example, the applicator can have in cross-section through the thickness a flattened shape.

In cross-section through the thickness, the applicator can also have, for example, a convex shape, at least on the side of the first face of the backing sheet.

When viewed frontally, the applicator can have a circular shape, or alternatively a non-circular shape, for example, a generally triangular, polygonal, oval, drop or almond shape.

Before the first use, the device can be contained in a sachet. Alternatively or additionally, a protective sheet can be placed against the first face so as to cover at least the applicator, and the protective sheet can be attached to the first face of the backing sheet, around the applicator. The protective sheet can be attached in a permanent manner, for example by gluing.

The device can also include several applicators.

In another of its aspects, the invention provides a method of applying a cosmetic product by a device such as that just described. The method includes pulling back the film so as to at least partially expose the second face of the backing sheet situated at least partially against the applicator. One or more fingers are placed on the exposed second face situated against the applicator. The applicator is lifted away from the rest of the backing sheet, and the first face of the applicator is applied to the area to be treated.

When the film includes a portion separable from the rest of the film, it is possible to grasp the device on a part located around the cut line or line of weakening of the film, and pull back the detachable portion of the film so as to at least partially expose the second face of the backing sheet situated at least partially against the applicator or in other words in the region of the applicator. One or more fingers are then placed on the exposed second face, and the applicator is lifted away from the rest of the backing sheet. The first face of the applicator is then applied to the area to be treated.

Devices according to the invention can particularly be useful for the application of a cosmetic or dermatological product, such as a disinfectant, a sunscreen, a moisturising product, an anti-wrinkle product, a nail varnish, a foundation, a blusher, an eyeshadow, a lip color, a makeup remover, a hair care product, a hair coloring product, a deodorant or antiperspirant product, or a perfume.

The invention further provides, independently or in combination with the foregoing, an applicator device for a cosmetic product which includes a backing sheet or backing sheet assembly delineating at least one recess, with at least one applicator held in the recess. The applicator can include a first face incorporating the cosmetic product, and a second face which has an adhesive associated therewith, for example with the second face at least partially coated with an adhesive. The adhesive could also be provided on part or all of the second face of the backing. A film extends over at least the adhesive part of the second face of the applicator, for example with the film incorporating a cut line or line of weakening extending at least partially around the applicator so as to delineate a portion which is at least partially detachable and which at least partially covers the applicator. In addition, when it is the film or the detachable portion is detached or moved to an open position, access to the applicator is provided to allow the applicator to be lifted off by its adhesive face. The film can also be in contact with adhesive associated with the backing sheet around the applicator.

In this embodiment, the applicator can be made, for example, from a sheet separate from the backing sheet instead of being cut out of the backing sheet as previously described. The applicator can, for example, have the same thickness as the backing sheet and a cross-section substantially identical to that of the recess so that it has substantially the same dimensions as the recess. The applicator can therefore be held with sufficient friction in the recess defined by the backing sheet so that it remains in the recess when the detachable portion of the film is pulled off. The applicator can nevertheless slide inside the recess allowing it to be lifted off by its adhesive face.

As should be apparent, the invention can provide a number of advantageous features and benefits. It is to be understood that, in practicing the invention, an embodiment can be constructed to include one or more features or benefits of embodiments disclosed herein but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will become further apparent from the following description, particularly when considered in conjunction with the drawings in which.

DETAILED DESCRIPTION OF THE PREFERRED EMBODIMENTS

By way of example, the device for application of a cosmetic product depicted in FIGS. 1 to 7 includes a backing sheet 20 in which an applicator 10 is cut out. The applicator is designed to adhere to one or more fingers for the purpose of applying a product to the skin, mucous membranes, other external parts of the body, or the hair.

The backing sheet 20 is, for example, composed of a closed cell polyethylene film. The material is preferably resiliently deformable so as to obtain a relatively flexible application. In addition, the backing sheet can include a skin on its external surface.

As a variant, the backing sheet 20 can include, for example, a layer of a porous or fibrous material, such as an open-cell foam or any other cellular structure, such as a natural or synthetic sponge, or felt or fibrous structures such as cotton or textile materials. The backing sheet 20 can alternatively include several superimposed films and/or several layers of porous or fibrous material.

Preferably the backing sheet 20 has a substantially constant limited thickness thereby imparting a flattened shape to the applicator. The backing sheet 20 has a thickness of approximately 600 μm for example.

In the example shown, the applicator 10 presents a circular shape when viewed frontally. It has a diameter of 15 mm for example. Such an applicator is particularly suitable for the application of a product to a small area of the face, for example the eyelids, in which case the applicator can be attached to a single finger. To make applicators suitable for the application of a product such as a foundation to the whole face, a bigger applicator is preferably used, having a diameter of approximately 45 mm, for example, and which adheres to several fingers.

Figure 12:
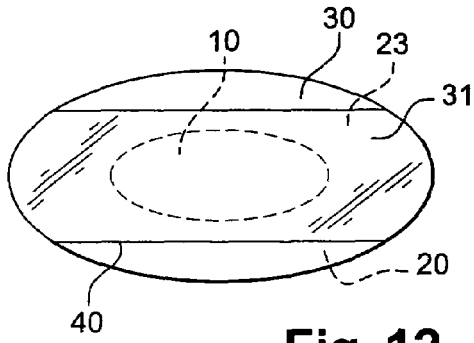

Alternatively, when viewed frontally, the applicator 10 can have a shape other than circular, for example to enable a product to be applied more easily or more precisely to a given part of the face. By way of example, FIGS. 9 to 12 show frontal views of different examples of possible shapes among a number of others. When viewed frontally, the shape of the applicator 10 can be substantially rectangular (FIG. 9), oval (FIG. 10), triangular (FIG. 11), or elliptical (FIG. 12). Further by way of example, the applicator can also be almond-shaped or drop-shaped when viewed frontally.

Figure 13:
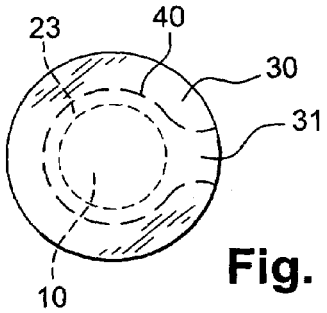

In the example illustrated in FIGS. 1 to 7, the backing sheet 20 has a square shape. Alternatively, the shape of the backing sheet 20 can be elliptical as illustrated in FIG. 12, or circular as can be seen in FIG. 13, or any other shape.

Figure 2:
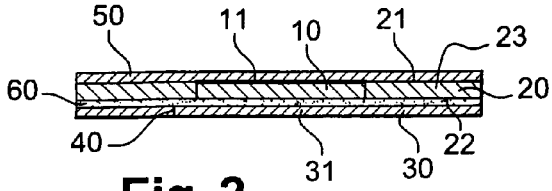
FIG. 2 is a sectional view of the device in FIG. 1.
Figure 3:
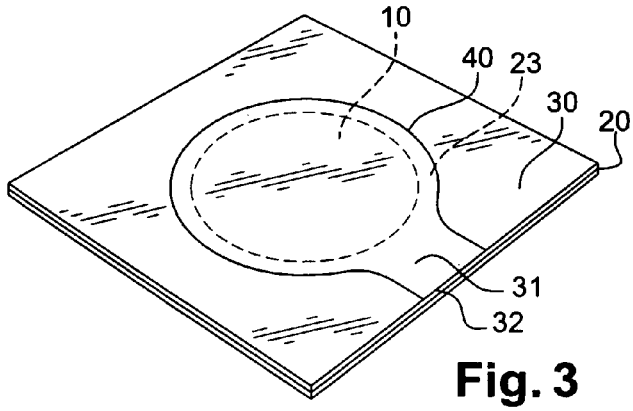
FIG. 3 illustrates a bottom view of the device in FIG. 1.

Referring to FIG. 2, it can be seen that the backing sheet 20 includes a first face 21 which defines, for the applicator 10, an application surface.

In the example shown, the applicator 10 presents a flat application surface. Alternatively, the application surface can be curved, for example outwardly convex.

Figure 14:
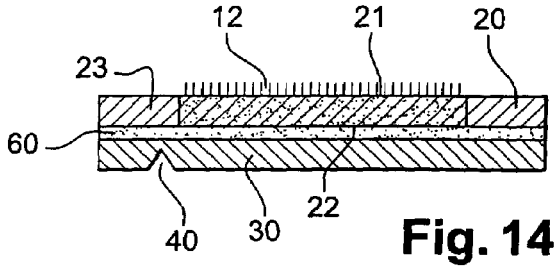

The application surface of the applicator can also include a flock covering 12 as depicted in FIG. 14. The application surface could also be covered with various other materials such as a non-woven or woven material.

In the example illustrated in FIGS. 1 to 7, the first face 21 of the backing sheet is covered with a layer of product 11, with the product layer 11 preferably covering only the portion corresponding to the applicator 10. The product can be a powder deposited by screen printing. The product is for example a lip colour, an eyeshadow, a foundation, a blusher, etc.

Alternatively, it can be arranged that the product is not deposited at the surface, but that the applicator 10 is impregnated with product. For example, the applicator depicted in FIG. 14 can be particularly desirable for an arrangement in which the product is impregnated in the applicator. In this example, the applicator is made of a porous material, for example foam, which is impregnated with the product to be applied. The applicator 10 can for example be impregnated using a stencil thereby providing a simple means of placing product on the applicator without overflowing around the applicator. As used herein, reference to a product being "associated" with the first face of the applicator includes the situation in which the product is deposited on the first face as well as situations in which the product is provided by other expedients such as with the product impregnated in the applicator so that it can be applied with the first face. Similarly, reference to an adhesive being associated with the second face includes arrangements in which the second face is coated (partially or entirely thereon) with an adhesive as well as arrangements in which an adhesive is provided by other expedients (e.g., an adhesive film or other expedients) to provide an adhesive contact.

Opposite the first face 21, the backing sheet 20 includes a second face 22 with an adhesive layer 60 coated or otherwise associated therewith.

The adhesive can be a permanent, water-resistant, hypoallergenic adhesive which adheres more strongly to the applicator than to the skin. The adhesive layer 60 can be in the form of a film which can cover the entire second face 22 of the backing sheet and in particular the applicator. The adhesive layer can also be in the form of a pattern of dots, a series of strips or other forms, or may extend only in the central region of the second face 22 of the backing sheet. The adhesive layer can also be covered, for example, by a mesh to reduce its bonding capacity.

In the example illustrated, the portion of the backing sheet surrounding the applicator is entirely adhesive-coated. However, the portion of the backing sheet surrounding the applicator could be only partially adhesive-coated, for example.

Before first use, the adhesive layer 60 is entirely covered by a film 30. The film 30 is made for example of silicone-treated paper or polyethylene film.

The film 30 in the illustrated example includes a cutout 40 which divides the sheet into two parts so as to delineate a detachable portion 31. The detachable portion 31 can thus be completely detached from the rest of the film in this example.

As a variant, provision can be made for the detachable portion 31 to remain partly integral with the rest of the film while allowing the applicator to be lifted off.

Preferably, the detachable portion 31 is partially delineated by a peripheral edge 32 of the film 30 so that it can be readily grasped by the user.

In the example illustrated in FIGS. 1 to 7, the line 40 is cut in a continuous manner.

Alternatively, the line 40 can be cut in a discontinuous manner, i.e. in a dotted fashion, with the detachable portion 31 being integral with the rest of the film by uncut portions, as in the example illustrated in FIG. 13.

In another embodiment, the film 30 can include a line of weakening 40 provided by an area of lesser thickness, i.e. a line thinner than the rest of the film 30, as illustrated in FIG. 14.

Figure 8:
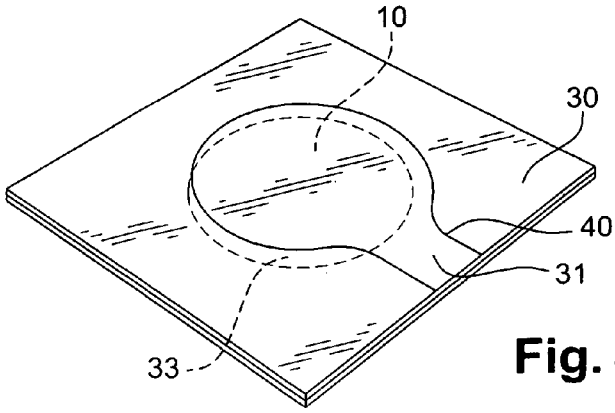
FIGS. 8 to 16 illustrate examples of additional embodiments or variants of the device according to the invention.
Figure 4:
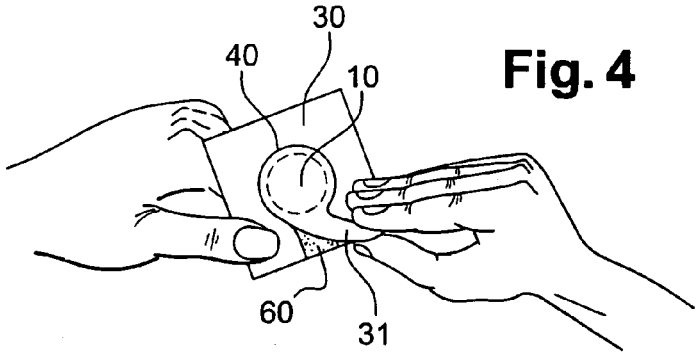
FIGS. 4 to 7 illustrate different steps involved in the use of the device in FIG. 1.
Figure 9:
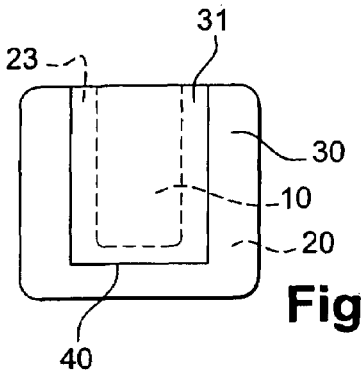
Figure 10:
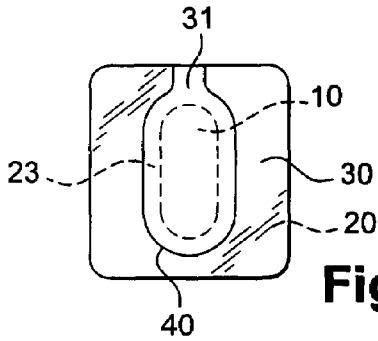
Figure 11:
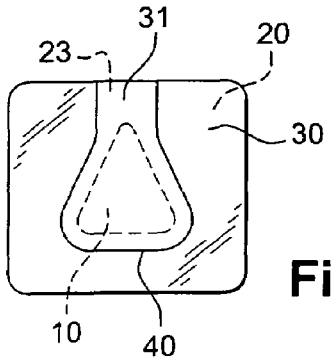
Figure 15:
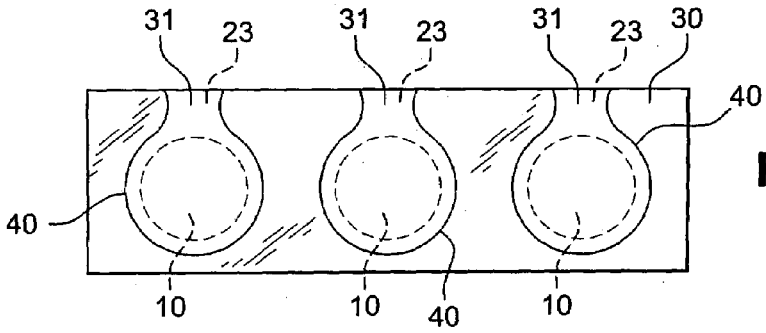

The cut line or line of weakening can be curved as shown in the examples in FIGS. 13 and 15, or alternatively straight as shown in the examples in FIGS. 9 and 12. As a further alternative, the cut line or line of weakening can include straight portions and curved portions, as shown in the examples in FIGS. 1, 8, 10 and 11.

In the examples illustrated in FIGS. 1 and 9 to 13, the line 40 extends fully around the applicator thereby delineating a detachable portion 31 completely covering the applicator. When it is separated from the rest of the film, the detachable portion 31 can give access to the entire applicator.

The line 40 can alternatively extend only partially around the applicator 10 thereby delineating a detachable portion 31 partially covering the applicator, as depicted in FIG. 8. When it is separated from the rest of the film, the detachable portion 31 then gives access to only part of the applicator, with a small portion 33 of the film covering a small portion of the applicator. However, the detachable portion covers a sufficiently large surface area of the applicator so that substantially all of the applicator surface can be exposed. Thus, even if there is only a small part of the applicator that is not exposed, the applicator can be completely lifted off the device by sliding under the small portion 33 of the film.

Figure 16:
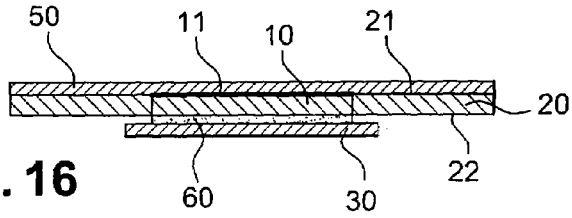

As a variant, provision can be made so that the film 30 does not include a cut line or a line of weakening, as illustrated in FIG. 16. In this variant, the second face 22 of the backing sheet is adhesive-coated only against the applicator or in the region of the applicator. A film 30 without cut line or line of weakening covers the second face 22 of the backing sheet 20, over its entire surface or preferably over a central part of the second face 22 thereby covering the adhesive-coated face of the applicator.

Figure 1:
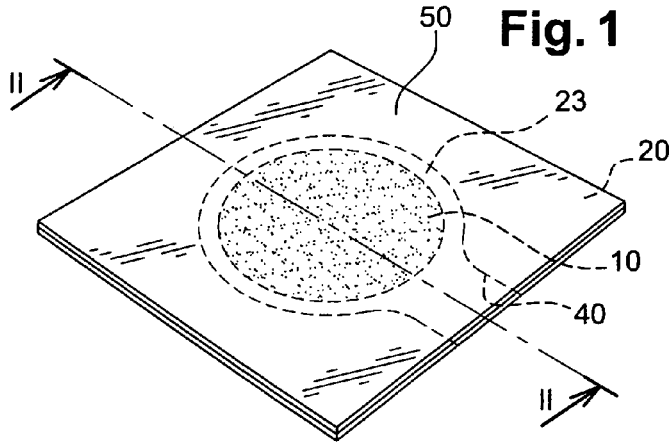
FIG. 1 illustrates a perspective view of a first embodiment of a device according to the invention.

To protect the product layer 11 and the application surface, the backing sheet 20 and the applicator are covered, as can be seen in FIGS. 1 and 2, with a protective sheet 50, for example a polypropylene or PVC film. By way of example, the protective sheet can be permanently attached to the portion of the backing sheet 20 surrounding the applicator 10. The film is attached to the sheet by gluing for example. Alternatively, provision can be made for the protective sheet 50 not to be permanently attached. It may then be attached to the backing sheet 20, for example, by static effect only. The protective sheet 50 has a thickness of 0.2 mm for example.

Alternatively or additionally, the applicator 10 can be packaged in a sachet for example.

In a variant illustrated in FIG. 15, the device can include several applicators 10 cut out in the same backing sheet 20. The backing sheet 20 includes for example three applicators 10 and an equivalent number of cut lines 40. Each cut line 40 surrounds one applicator 10 thereby delineating a detachable portion 31 covering each applicator. The detachable portions 31 can be removed successively as the applicators are used. The applicators can for example be coated with different products.

Figure 5:
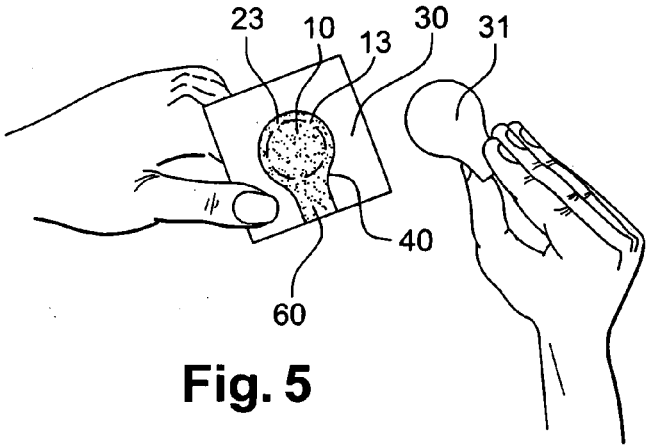

To make the device illustrated in FIGS. 1 to 7, it is possible, according to one example of the method, to apply a double-sided adhesive between the second face 22 of the backing sheet 20 and the film 30. The line 40 is cut in the film 30. The backing sheet and the adhesive layer are then cut to the desired shape of the applicator, using a die-cutter for example, leaving bridges of material 13 (FIG. 5) thereby keeping the applicator 10 and the rest of the backing sheet 20, 23 in one piece (as shown in FIG. 5, element 13 identifies a bridge portion, while element 23 identifies backing portions outside the area of the applicator 10 which are connected by bridge portions 13). The product to be applied is then deposited, for example by screen printing, onto the portion of the first face 21 of the backing sheet corresponding to the applicator 10. The protective sheet 50 is then affixed to the first face 21 of the backing sheet, around the applicator 10. The assembly thus obtained can then be cut to the desired shape, for example to produce a square card resulting in the device illustrated in FIG. 1.

Figure 6:
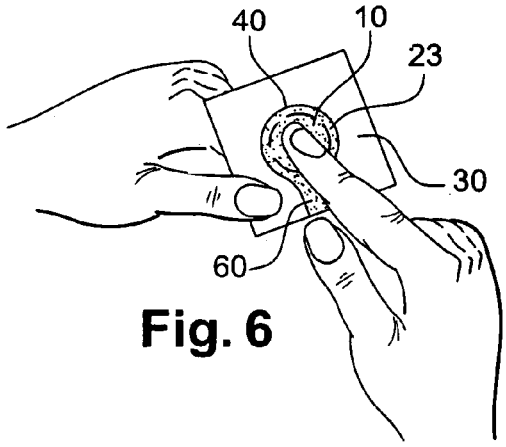
Figure 7:
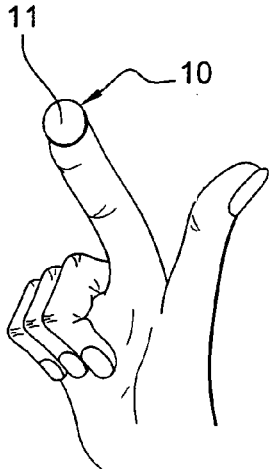

To use the applicator according to the invention, the user grasps the device by a portion located outside the cut line 40 with one hand. The user then detaches the detachable portion 31 from the rest of the film 30 thereby exposing the whole of the adhesive face 60 of the applicator, as illustrated in FIG. 5. The user can then place a finger on the exposed adhesive layer 60, as can be seen in FIG. 6. Finally, the user lifts the applicator 10 off the rest of the backing sheet 20 to hold the applicator 10 by the pad of the finger (FIG. 7). The applicator 10 is then in place on the user's fingers, and the user can then apply the product to the area to be treated without ever touching the application surface beforehand.

The card-shaped device just described can be used as a product sample and can be distributed for example via magazines into which it is slid or attached.

In the foregoing detailed description reference is made to preferred embodiments of the invention. It is evident that variants thereto can be proposed without departing from the invention as claimed here below. It is therefore to be understood that, within the scope of the appended claims, the invention may be practiced otherwise than as specifically described herein.

What is claimed as new and desired to be secured by letters patent of the United States is:

1. An applicator device for a product comprising:

a backing sheet in which at least one applicator is cut out or pre-cut, said backing sheet including:

a) a first face which can hold the product at least in a region of at least part of the applicator; and b) a second face having an adhesive associated therewith over at least part of the applicator;

a film extending over at least the adhesive of the second face, wherein said film is at least partially detachable from the backing sheet to give access to the applicator and enable the applicator to be lifted off by the adhesive on the second face.

2. A device according to claim 1, wherein the film includes a cut line or line of weakening extending at least partially around the applicator so as to delineate a detachable portion of the film that is at least partially detachable from the backing sheet, wherein said detachable portion of the film at least partially covers the applicator, and wherein when said detachable portion of the film is separated from the rest of the film, access is provided to the applicator to allow it to be lifted off by the adhesive associated with the second face.

3. A device according to claim 2 , wherein the line is a discontinuous cut line.

4. A device according to claim 2, wherein the line is a continuous cut line.

5. A device according to claim 2, wherein the line is a line of weakening having a thickness less than a thickness of an adjacent portion of said film.

6. A device according to claim 2, wherein the detachable portion of the film is at least partially delineated by a peripheral edge of the film.

7. A device according to claim 2, wherein said at least one applicator is completely surrounded by other portions of said backing sheet, and wherein the detachable portion of said film includes a portion covering the applicator on the second face of the backing sheet, and wherein the detachable portion extends to an edge of said device.

8. A device according to claim 2, wherein the second face of the backing sheet further includes the adhesive in at least one portion external to the applicator.

9. A device according to claim 1, wherein prior to a first use the applicator is connected to remaining portions of backing sheet.

10. A device according to claim 9, wherein the applicator is connected to the remaining portions of the backing sheet by at least one bridge of material.

11. A device according to claim 1, wherein the backing sheet includes portions surrounding an entire periphery of the applicator.

12. A device according to claim 1, wherein the backing sheet is impregnated with a product to be applied.

13. A device according to claim 1, wherein the first face of the backing sheet is covered by a layer of a product to be applied.

14. A device according to claim 1, further including a cosmetic product associated with the first face of the backing sheet in a region of at least part of said applicator.

15. A device according to claim 1, wherein the first face of the backing sheet includes a product associated therewith only in a region of the applicator.

16. A device according to claim 15, wherein the product is a cosmetic product.

17. A device according to claim 1, wherein the backing sheet is made of a porous or fibrous material.

18. A device according to claim 1, wherein the backing sheet includes at least one material selected from the group consisting of: a thermoplastic foam material, a sponge, a felt, a non-woven material, a woven material, and a natural fiber material.

19. A device according to claim 1, wherein the backing sheet is made of a resiliently deformable material.

20. A device according to claim 1, wherein the backing sheet has a multi-layered structure.

21. A device according to claim 1, wherein the first face of the backing sheet is covered with at least one material selected from the group consisting of: a flock material, a non-woven material, and a woven material.

22. A device according to claim 1, wherein the film comprises silicone-treated paper.

23. A device according to claim 1, wherein the adhesive associated with the second face of the backing sheet is a hypoallergenic adhesive.

24. A device according to claim 1, wherein the second face of the backing sheet is entirely covered with adhesive.

25. A device according to claim 1, wherein the second face of the backing sheet includes a first portion associated with the applicator and at least one second portion external to the applicator, and wherein the adhesive is associated with said first and second portions.

26. A device according to claim 1, wherein the applicator has a cross-section through a thickness of the applicator having a flattened shape.

27. A device according to claim 1, wherein the applicator has a cross-section through a thickness of the applicator having a convex shape at least on a side of the first face of the backing sheet.

28. A device according to claim 1, wherein when viewed frontally the applicator has a circular shape.

29. A device according to claim 1, wherein when viewed frontally the applicator has a non-circular shape.

30. A device according to claim 29, wherein the applicator has a shape selected from the group consisting of: a generally triangular shape, a polygonal shape, an oval shape, a drop shape and an almond shape.

31. A device according to claim 1, further including a protective sheet which is placed against the first face so as to cover at least the applicator on the first face.

32. A device according to claim 1, wherein the device includes a plurality of applicators.

33. A device according to claim 1, further including at least one product associated with the applicator selected from the group consisting of: a cosmetic product, a dermatological product, a disinfectant, a sunscreen, a moisturising product, an anti-wrinkle product, a nail varnish, a foundation, a blusher, an eyeshadow, a lip color, a makeup remover, a hair care product, a hair coloring product, a deodorant, and anti-perspirant product, and a perfume.

34. A device according to claim 1, wherein said at least one applicator is surrounded by other portions of said backing sheet, and wherein said device includes a plurality of said applicators, and further wherein a separate detachable film is associated with each of said plurality of applicators.

35. A device according to claim 1, where in after the applicator is lifted off a recess is left in the backing sheet having a shape corresponding to a shape of the applicator.

36. An applicator device for a product comprising:

a backing sheet assembly delineating at least one recess;

an applicator disposed in said recess, said applicator including a first face defining an applicator surface and a second face defining a grasping surface, wherein an adhesive is associated with said second face such that said applicator can be held by said adhesive of said second face;

a detachable cover covering said second face of said applicator wherein said detachable cover is at least partially detachable such that upon at least partial detachment of said detachable cover said second face is exposed to allow the applicator to be lifted from said recess by the adhesive associated with the second face;

wherein said detachable cover covers at least a portion of said backing sheet assembly outside of said recess; and wherein a film is provided over said second face of said applicator and over at least part of said backing sheet assembly, and wherein said detachable cover is delimited by a cut line or a line of weakening in said film.

37. An applicator device according to claim 36, wherein said applicator has a thickness which is substantially the same as that of the recess delineated on said backing sheet assembly.

38. An applicator device according to claim 36, wherein said applicator includes a material which is the same as that of said backing sheet, and wherein prior to removal of said applicator from said recess, said applicator is coupled to said backing sheet by at least one bridge formed of said material and extending between said backing sheet and said applicator.

39. An applicator device according to claim 36, wherein an outer periphery of said applicator is in frictional contact with an inner periphery of said recess of said backing sheet assembly prior to removal of said applicator from said recess.

40. An applicator device according to claim 36, wherein said detachable cover is partially detachable from said film such that the detachable cover can be moved from a covering position to an open position, and wherein in said open position at least part of the second face of the applicator is exposed to allow removal of said applicator from said recess by way of said adhesive, and further wherein in said open position part of said detachable cover remains coupled to remaining portions of said film.

41. An applicator device according to claim 36, further including a product associated with said first face of said applicator.

42. An applicator device according to claim 41, further including a protective sheet covering said first face of said applicator.

43. An applicator device according to claim 42, wherein said detachable cover extends to an edge of said device.

44. An applicator device according to claim 36, wherein said detachable cover extends to an edge of said device.

* * * * *